United States Patent [19]

Churchman et al.

[11] Patent Number: 5,022,427

[45] Date of Patent: Jun. 11, 1991

[54] ANNULAR SAFETY SYSTEM FOR GAS LIFT PRODUCTION

[75] Inventors: Ronald K. Churchman, Carrollton; Michael W. Meaders; Nam Van Le, both of Lewisville, all of Tex.

[73] Assignee: Otis Engineering Corporation, Carrollton, Tex.

[21] Appl. No.: 487,398

[22] Filed: Mar. 2, 1990

[51] Int. Cl.[5] ..... F04F 1/20

[52] U.S. Cl. ..... 137/155; 137/630.15

[58] Field of Search ..... 137/155, 630.15, 630.14; 417/109, 111, 115

[56] References Cited

U.S. PATENT DOCUMENTS

| | | | |
|---|---|---|---|
| 2,710,019 | 6/1955 | Reasoner | 137/630.15 X |
| 3,592,561 | 7/1971 | Chenoweth | 137/155 X |
| 3,631,887 | 1/1972 | Schèchtriem | 137/630.15 X |
| 4,111,608 | 9/1978 | Elliott | 417/115 X |
| 4,294,313 | 10/1981 | Schwegman | 166/117.5 |
| 4,295,796 | 10/1981 | Moore | 417/115 |
| 4,480,697 | 11/1984 | Goldaniga et al. | 166/372 |
| 4,524,833 | 6/1985 | Hilts et al. | 166/381 |
| 4,540,047 | 9/1985 | Akkerman | 166/188 |
| 4,589,482 | 5/1986 | Bayh, III | 166/105.5 |
| 4,624,310 | 11/1986 | Echols et al. | 166/106 |
| 4,632,184 | 12/1986 | Renfroe, Jr. et al. | 166/105.5 |
| 4,682,656 | 7/1987 | Waters | 166/372 |

OTHER PUBLICATIONS

Geyelin, J. L., "Field Experience in Down Hole Annulus Safety Valve", Society of Petroleum Engineers, SPE No., p. 19278/1, Sep. 5, 1989.

*Primary Examiner*—Alan Cohan

*Attorney, Agent, or Firm*—Dennis T. Griggs

[57] ABSTRACT

A lift gas safety valve has a compound valve closure assembly which will close automatically upon loss of hydraulic control pressure, and which can be reopened and maintained in the open position by the application of hydraulic control pressure at a relatively low pressure level. A primary valve closure member is slideably mounted onto a valve stem for movement to a seated position on the valve body in which a lift gas flow passage is closed, to an unseated position in which the lift gas flow passage is opened. A bypass flow passage is formed between the stem and the primary valve closure member for establishing fluid flow communication between the lift gas flow passage and the outlet port when the primary valve closure member is in its seated position. The auxiliary valve closure member is mounted onto the valve stem for movement from a seated position on the primary valve closure member to an unseated position for selectively closing and opening the bypass flow passage. According to this arrangement, when the auxiliary valve closure member is moved to its open position, the pressure differential across the safety valve is equalized, thereby permitting the main valve closure member to be unseated by the application of hydraulic control fluid at a relatively low pressure level.

12 Claims, 5 Drawing Sheets

VALVE CLOSED

VALVE EQUALIZING

VALVE OPEN

ANNULAR SAFETY SYSTEM FOR GAS LIFT PRODUCTION

FIELD OF THE INVENTION

This invention relates generally to well completion and production, and in particular to a lift gas safety valve for completing and producing a gas lift well.

BACKGROUND OF THE INVENTION

Gas lift is a commonly used method for producing wells which are not self flowing. Gas lift consists of initiating or stimulating well flow by injecting gas at some point below the fluid level in the well. When gas is injected into the formation fluid column, the weight of the column above the point of injection is reduced as a result of the space occupied by the relatively low density gas. This lightening of the fluid column is sufficient in some wells to permit the formation pressure to initiate flow up the production tubing to the surface. Gas injection is also utilized to increase the flow from wells that will flow naturally but will not produce the desired amount by natural flow.

In gas lift operations, the well may be produced through either the casing or the production tubing. If the well is produced through the casing, the lift gas is conducted through a tubing string to the point of injection, and if the well is produced through production tubing, the lift gas is conducted to the point of injection through the casing annulus or through an auxiliary tubing string.

DESCRIPTION OF THE PRIOR ART

There are numerous conventional gas lift arrangements, including various designs for flow valves which may be installed in the tubing string for providing controlled injection of lift gas in response to a predetermined pressure differential between the casing tubing annulus and the production tubing. When the flow valve opens, gas is injected into the production tubing to initiate and maintain flow until the production tubing pressure drops to a predetermined value. The valve is set to close before the input gas/oil ratio becomes excessive. Other flow valve arrangements are designed to maintain continuous flow, predetermined pressure differential and desired gas injection rate for efficient operation.

In prior installations, the upper production tubing string is provided with a safety valve connected therein, and a control fluid conduit along with the gas lift tubing are separately installed and anchored to the upper end of a hanger packer. In such installations, there is a risk of disturbing the packer and the flow conductors in the well while performing the installation and removal of the safety valves and upper tubing sections. Such prior installations have not provided means for equalizing the lift gas pressure in the casing annulus above and below the packer to accommodate a well operating condition in which it is necessary to pull or service the subsurface gas lift safety valve. Equalization and/or relief is essential for safe wire line servicing in large volume gas lift operations because of the high gas pressure levels which are developed within the casing annulus below the hanger packer. Equalization has been accomplished in the past by pumping compressed natural gas or air into the upper annulus.

Typically, a pressurized source of natural gas is available at the well and is pumped into the annulus below the packer for lift purposes. The natural gas may be available at a substantially high pressure, for example, 5,000 psi. It is desirable to be able to completely close off the high pressure natural gas contained within the annulus below the packer to prevent it from being vented to the surface by reverse flow through the packer. Such reverse flow is prevented by the lift gas safety valve which closes automatically upon loss of hydraulic control pressure. Hydraulic control pressure may be interrupted as a result of storm damage, fire, electrical failure, freeze damage and the like at the well head.

A limitation on the use of prior art lift gas safety valves is the relatively high level of hydraulic control pressure required to maintain the lift gas safety valves in the valve open position. The limited available volume in the side pocket mandrel constrains the safety valve components to be long and slender. Consequently, conventional lift gas safety valves have long, slender hydraulic pistons in which the ratio of the effective piston area acted upon by the hydraulic control fluid relative to the effective safety valve area which is acted upon by the lower annulus lift gas pressure is typically about 1:5. Accordingly, if the lift gas pressure level within the lower well annulus is 5,000 psi, and assuming a piston/-valve ratio of 1:5, a hydraulic control pressure in excess of 25,000 psi must be applied to the safety valve piston to open the lift gas safety valve.

Such high hydraulic control line pressures are dangerous and are difficult to produce in deep wells having long control lines. Prior art attempts to reduce the pressure level of the hydraulic control fluid by increasing the effective diameter of the piston relative to the valve closure member have not been successful because of the inherent limitation that the effective area of the valve closure member must be larger than the effective piston are to guarantee fail-safe operation of the safety valve. Moreover, in such installations in which the piston/closure member ratio has been increased toward 1:1, there has been a corresponding reduction in the production flow area of the side pocket sub in which the lift gas safety valve is installed because of the overall increase in side pocket diameter imposed by the increased piston size.

There may be instances in which the operator desires to circulate lift gas from below the packer to above the packer or merely establish communication between the lower and upper annulus to monitor the pressure within the annulus below the packer. In such instances, it is desirable to provide such flow communication by surface controllable means. Moreover, the safety valve for controlling the circulation of lift gas must be capable of automatically closing, or remaining closed, in the event the supply of hydraulic control fluid is lost, for example, as a result of damage to well head equipment at the surface.

The following U.S. patents disclose valves for controlling lift gas flow:

| | | |
|---|---|---|
| 4,682,656 | 4,632,184 | 4,624,310 |
| 4,589,482 | 4,540,047 | 4,524,833 |
| 4,480,697 | 4,295,796 | 4,294,313 |

OBJECTS OF THE INVENTION

The principal object of the present invention is to provide an improved subsurface lift gas safety valve which can be maintained in the valve open position by a relatively low hydraulic control pressure as compared to conventional lift gas safety valves.

A related object of the present invention is to provide an improved subsurface lift gas safety valve which will close automatically upon loss of control fluid pressure, and which can be reopened and maintained in the open position by the application of control fluid pressure at a pressure level which is substantially less than the pressure level required for reopening conventional lift gas safety valves.

Another object of the invention is to provide an improved lift gas safety valve which is surface controllable for equalizing the pressure in the casing annulus above the packer to accommodate a wire line service operation on equipment located above the packer.

Another object of the invention is to provide an improved surface controlled lift gas safety valve for use in a well which has been previously completed with a flow conductor in place.

A related object of the invention is to provide an improved lift gas safety valve for use in a gas lift well for conducting lift gas from a surface facility through a hanger packer into the casing annulus below the packer.

SUMMARY OF THE INVENTION

The foregoing objects are achieved according to the present invention by a fluid flow control valve assembly of the type including a valve body having an inlet port, an outlet port and a longitudinal bore defining a fluid flow passage in communication with the inlet port and the outlet port. Fluid communication between the valve body flow passage and the outlet port is selectively interrupted by first and second valve closure members. The first valve closure member is movably mounted onto the valve body for interrupting and establishing fluid communication between the valve body flow passage and the outlet port in response to retraction of the first valve closure member to a seated position on the valve body in which the fluid flow passage is closed, and is extendable to an unseated position in which the fluid flow passage is opened. A bypass flow passage is formed through the first closure member for establishing fluid flow communication between the valve body flow passage and the outlet port when the first valve closure member is in the seated position. A second valve closure member is movably mounted onto the valve body for movement from a seated position on the first valve closure member in which the bypass flow passage is blocked, to an unseated position in which the bypass flow passage is opened, thereby closing and opening the bypass flow passage in response to retraction and extension of the second valve closure member relative to the first valve closure member.

Extension and retraction of the first and second valve closure members is controlled by a hydraulic actuator. The first and second valve closure members are mounted onto a common valve stem which is extended and retracted in response to extension and retraction of a hydraulic piston. The safety valve can be opened by the application of hydraulic control fluid at a relatively low pressure level by first opening the second valve closure member to permit the pressure differential across the valve to be equalized. The effective piston area is slightly smaller than the equalizing seat area, whereby a relatively low hydraulic control pressure level only slightly greater than the shut in pressure plus the return force of the return spring is required to move the second valve closure member from its seat to permit equalization to occur. After equalization has been achieved, the main valve closure member can be unseated and the lift gas discharge port completely opened by the application of hydraulic control fluid at a pressure level which exceeds the sum of the opposing force developed by the return spring plus the equalization pressure of the injection gas in the casing annulus. Since the pressure differential across the valve is equalized, the main valve closure member and auxiliary valve closure member can be maintained in the fully open position at the reduced hydraulic control pressure level. In the event of failure of the hydraulic control pressure, the main closure member and auxiliary closure member are retracted automatically to their seated, closed valve positions by a return spring.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1A:
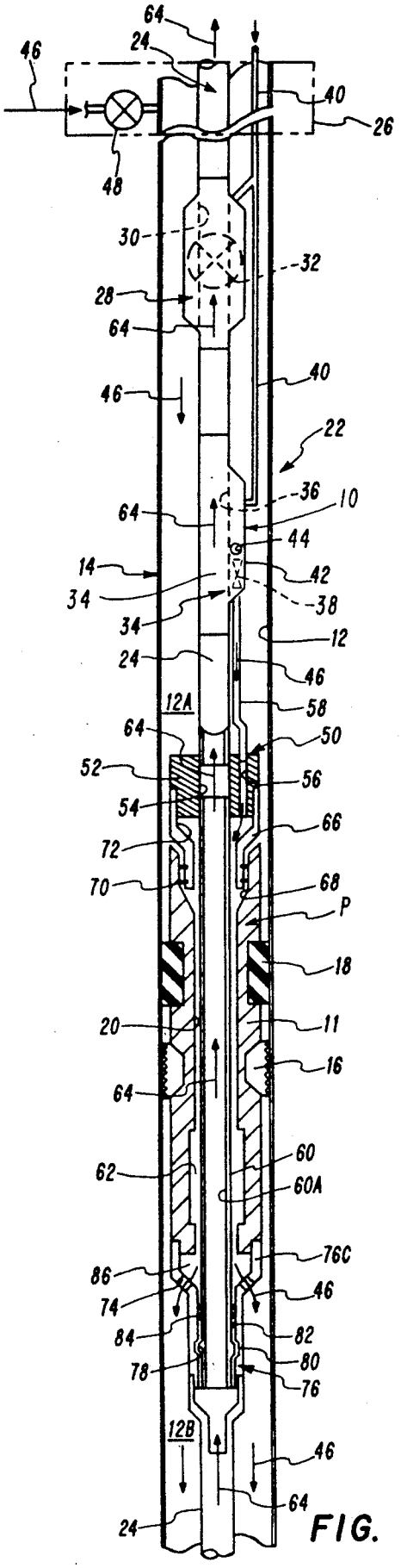
FIG. 1A is a view, partly in section and partly in elevation, showing a typical gas lift well installation in which the lift gas safety valve of the present invention is installed.

In the description which follows, like parts are marked throughout the specification and drawings with the same reference numerals, respectively. The drawings are not necessarily to scale and the proportions of certain parts have been exaggerated to better illustrate particular details of the present invention.

Referring now to FIG. 1A, the lift gas safety valve assembly 10 of the present invention is illustrated and described in connection with a gas lift installation in which a hanger packer P is releasably anchored at an appropriate depth within the bore 12 of a well casing 14. The packer P is provided with a mandrel 11 having mechanically or hydraulically actuated slips 16 which set the packer against the bore 12 of the well casing 14. The casing annulus is sealed above and below the packer by expanded seal elements 18, thereby dividing the casing annulus into an upper region 12A and a lower region 12B. The packer mandrel 11 has a large diameter, central bore 20 through which production flow and lift gas flow are separately conducted as hereinafter described.

A tubing retrievable completion assembly 22 is connected to a production tubing string 24 which is suspended from well head equipment 26. A surface controlled, subsurface production safety valve 28 having a production bore 30 and a movable valve closure element 32 is connected in series with the production tubing 24. The lift gas safety valve assembly 10 is mounted within a side pocket sub 34 having a production bore 36 connected in series with the production tubing 24. The lift gas safety valve assembly 10 includes a hydraulically actuated lift gas safety valve 38 which is coupled in fluid communication with a hydraulic flow control line 40. The lift gas safety valve 38 is received within an offset mandrel housing 42 which has an inlet port 44 through which lift gas 46 is admitted from the upper casing annulus 12A. The flow path of the lift gas 46 through the lift gas safety valve 38 is shown in greater detail in FIG. 2. The well head 26 includes a casing head through which the packer 10 and the completion assembly 22 are inserted into the well casing and which prevents the flow of fluids from the well casing annulus.

The production safety valve 28 is preferably of the flapper type as described in U.S. Pat. No. 4,449,587 to Charles M. Rodenberger, et al., or it may be of the ball valve closure type as described in U.S. Pat No. 4,448,216 to Speegle, et al. Both of these patents are incorporated by reference for all purposes within this application.

The well casing annulus 12A above the packer 10 is pressurized with lift gas 46, which is conducted into the upper casing annulus 12A through a surface valve 48 located at the well head 26. The hydraulic flow control line 40 delivers hydraulic fluid to the production safety valve 28 and lift gas safety valve 38 from a surface control unit located at the well head 26, which supplies hydraulic control fluid under pressure from a pump. Removal of hydraulic pressure from the control line 40 causes automatic release of spring loaded closure elements in the production safety valve 28 and the lift gas safety valve 38.

Figure 3:
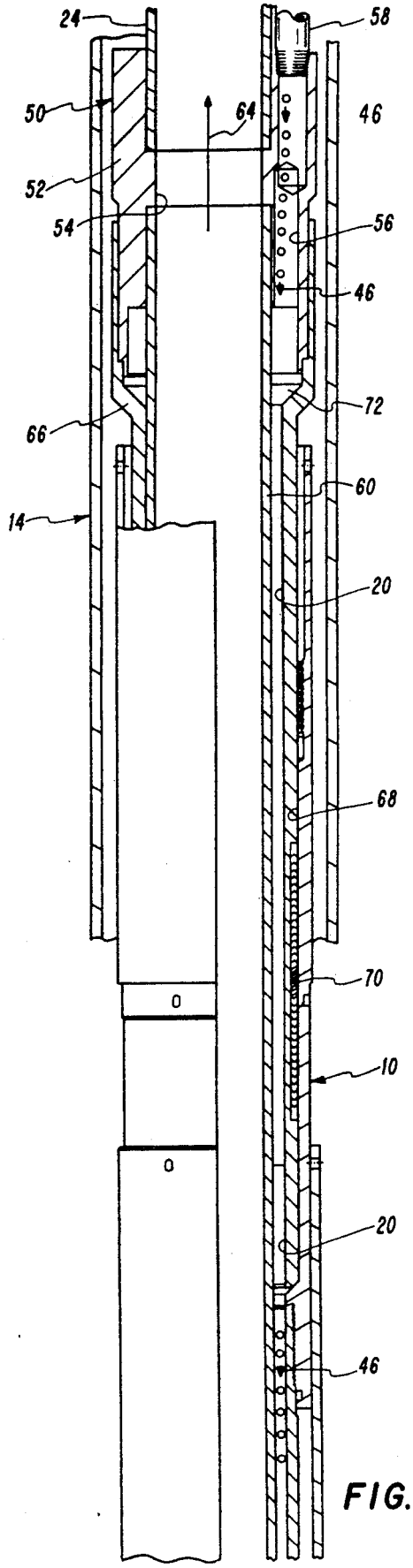
FIG. 3 is a view, partly in section and partly in elevation, showing engagement of the production seal unit with the bore of the hanger packer shown in FIG. 1.
Figure 4:
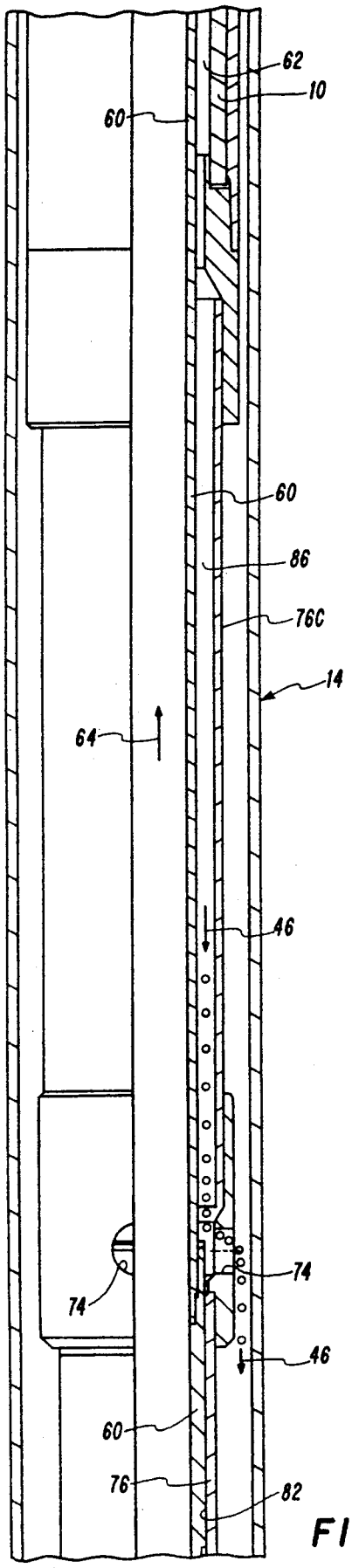
FIG. 4 is a view, partly in section and partly in elevation, illustrating the flow path for lift gas into the lower casing annulus below the hanger packer.

Referring now to FIGS. 1A and 3, an intermediate component of the tubing retrievable completion assembly 22 is a production seal unit 50 which is connected to the production tubing string 24. The production seal unit 50 includes a twin flow coupling head 52 which is intersected by a large diameter production bore 54. The coupling head 52 of the production seal unit 50 also includes a longitudinal bore flow passage 56 for conducting lift gas 46 conveyed through the lift gas safety valve 38. The lift gas 46 is conducted from lift gas safety valve 38 by a flow conduit 58 which connects the lift gas safety valve in fluid communication with the flow passage 56.

A production stinger conduit 60 is connected to the production seal unit 50 in fluid communication with the coupling head production bore 54. The production stinger conduit 60 is coaxially received within the packer bore 20, and projects through the lower end of the packer P. The annulus 62 between the packer bore 20 and the stinger conduit 60 defines a separate flow path which opens into the lower well casing annulus 12B below the packer P. The production stinger conduit 60, on the other hand, defines a separate flow path through which formation fluid 64 is produced.

An annular coupling collar 66 is attached to the lower end of the twin coupling head 52 and is received in telescopic engagement with a landing bore 68 of the packer P. Elastomeric seals 70 carried on the exterior of the coupling collar 66 form a fluid barrier against the landing bore 68 to prevent undesired fluid communication between the upper casing annulus 12A and the packer bore 20.

The gas lift flow passage 56 opens into the annulus 72 between the coupling collar 66 and the production stinger conduit 60. The coupling collar annulus 72 opens directly in fluid communication with the packer annulus 62. By pressurizing the upper annulus 12A with lift gas 46 through the well head valve 48, lift gas is admitted through the inlet port 44 of gas lift safety valve 38 where it is conducted through conduit 58 and coupling head flow passage 56 into the coupling collar annulus 72. The flow of lift gas 46 continues through the packer annulus 62 defined between the packer bore 20 and production stinger conduit 60.

Mutually coacting latching members, latch head 78 and detent groove 80, are carried by the production stinger conduit 60 and stinger nipple 76, respectively. The mutually coacting latching members releasably secure the position of the production seal unit 50 relative to the hanger packer P. The annulus 82 between the production stinger conduit 60 and the stinger nipple 76 is sealed by annular seal elements 84. The annulus 86 between coupling collar 76C and stinger conduit 60 is connected in direct flow communication with packer annulus 62 and lower casing annulus 12B by discharge ports 74.

Figure 1B:
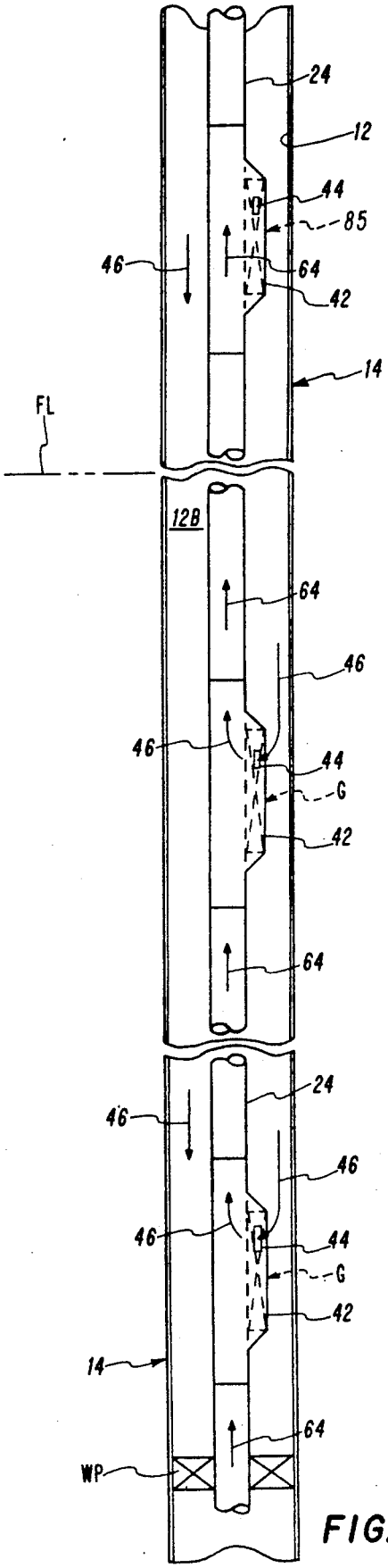
FIG. 1B is a continuation of FIG. 1A which illustrates the relative positions of a pressure relief valve and lift gas valves which are supported within the lower casing annulus below a hanger packer.
Figure 5:
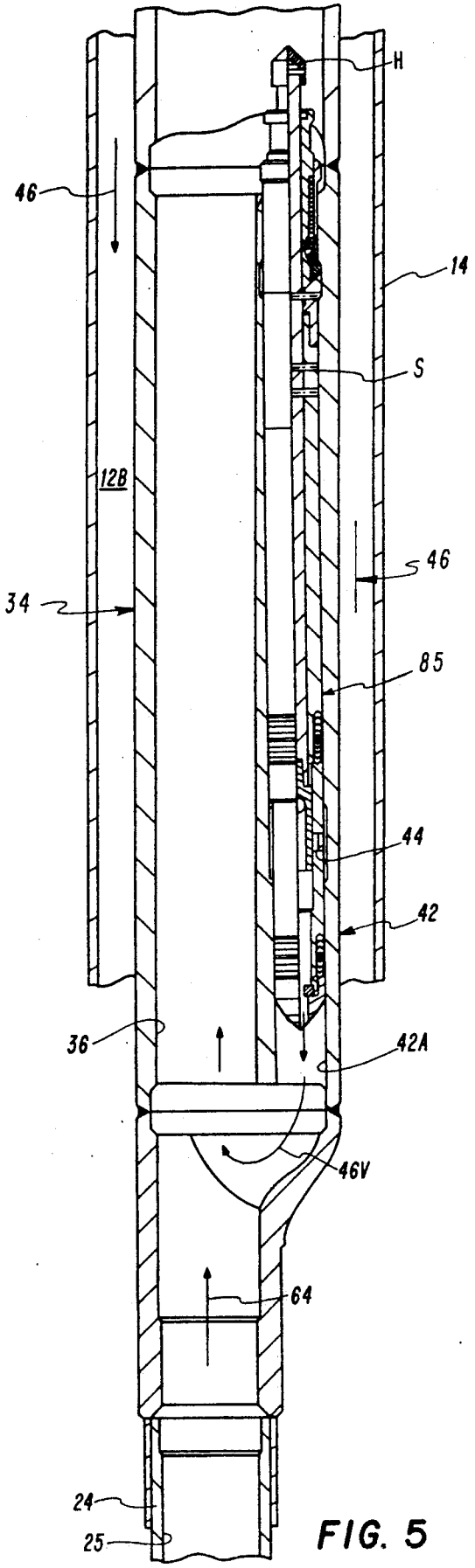
FIG. 5 is a view, partly in elevation and partly in section, illustrating details of the pressure relief valve shown in FIG. 1B.

Referring now to FIGS. 1A, 1B and 5, the tailpipe production string 24 includes a normally closed relief valve 85 mounted or releasably secured in a side pocket mandrel 34 of the type described above. The side pocket mandrel 34 includes a production bore 36 connected in communication with the bore 25 of production tubing 24, and an inlet port 44 which is normally closed by the relief valve 85. The side pocket mandrel in which the relief valve 85 is mounted is disposed above the fluid level FL as can be seen in FIG. 1B. When it is desired to relieve the pressure within the lower casing annulus 12B, a wire line tool is inserted through the production tubing string 24 and is jarred down against the actuator head H which shears pins S, with the result that the body of the relief valve 85 is displaced downwardly through bore 42A of the side pocket housing 42, thereby opening inlet port 44 so that high pressure gas 46 accumulated within lower casing annulus 12B is vented into the side pocket mandrel bore 36 and into the production bore 36 as indicated by the arrow 46V.

During the production mode of operation, the relief valve 85 is closed, and lift gas 46 is conducted through the lift gas safety valve 38 through port 74 into the lower casing annulus 12B until a desired operating pressure level is achieved. Production of formation fluid 64 is enhanced by injecting the lift gas 46 into the column of formation fluid below the fluid level FL through one or more gas lift valves G which are mounted onto the lower production tubing string below the hanger packer 10. It should be noted that in a typical gas lift installation, the relief valve 85 will be positioned above the fluid level FL at a relatively shallow depth of 500 feet, more or less, whereas the gas lift valves G will be located below the fluid level FL at much greater depths, for example 7,000–8,000 feet. Optional equipment such as a well packer WP is anchored within the lower casing annulus 12B below the gas lift valves G.

The gas lift valves G are received within a side pocket mandrel 34 of the type previously described. The side pocket mandrel 34 includes an offset mandrel housing 42 having an inlet port 44 through which lift gas 46 is admitted from the lower casing annulus 12B. An example of a gas lift valve G which is satisfactory for use in this invention is described in the aforementioned U.S. Pat. No. 4,294,313 to Harry E. Schwegman. Gas lift valve G is a check valve which can be inserted and removed from the side pocket mandrel a shown in the Schwegman patent. Gas lift valve G admits the flow of high pressure lift gas 46 from the lower casing annulus 12B into the bore of the production string 24, but blocks the flow of fluids in the reverse direction through port 44.

Formation fluid 64 enters the bore 25 of the lower production tubing string 24 and is conducted upwardly through the bore 60A of the production stinger conduit 60. The stinger conduit 60 opens into direct fluid communication with the lower production string 24 which is hung off of the stinger nipple 76. The upper end of the stinger conduit 60 is joined in fluid communication with the bore 25 of the upper tubing production string 24 at the production seal unit 50. The packer annulus 62 between the packer bore 20 and the stinger conduit 60 is connected through the mandrel ports 74 in direct fluid communication with the lower casing annulus 12B. The lower casing annulus 12B is pressurized to an appropriate pressure level by high pressure lift gas conducted through the lift gas safety valve 38, conduit 58 and packer annulus 62 for providing lift gas assistance for producing formation fluid 64 through the production tubing 24.

The lower casing annulus 12B remains pressurized for as long as lift gas 46 remains available and hydraulic control pressure is applied to the inlet port 90 of the lift gas safety valve 38. In the event the supply of hydraulic control fluid is lost, for example, as a result of damage to well head equipment at the surface, both the production safety valve 28 and the lift gas safety valve 38 are adapted to automatically close to prevent the loss of production fluids, and also to prevent the loss of the large volume of compressed lift gas 46 in the lower casing annulus. Upon removal of hydraulic pressure from the control line 40, spring loaded closure elements in the production safety valve 28 and in the lift gas safety valve 38 release spring loaded valve closure elements in the production safety valve 28 and in the lift gas safety valve 38, respectively.

Figure 2:
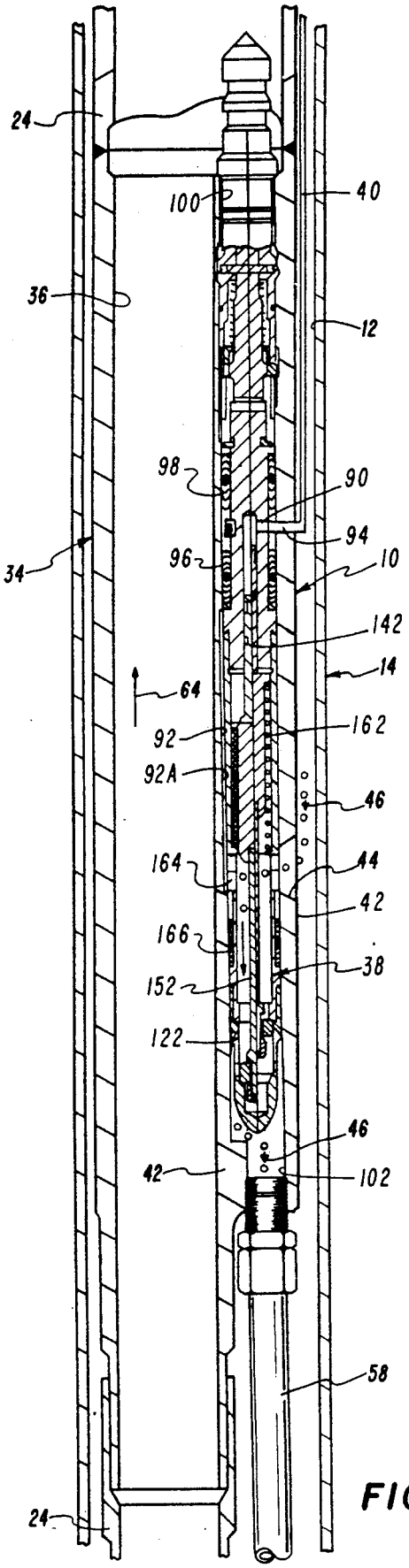
FIG. 2 is a split longitudinal sectional view of the gas lift safety valve and side pocket mandrel assembly showing valve open and valve closed positions.
Figure 6:
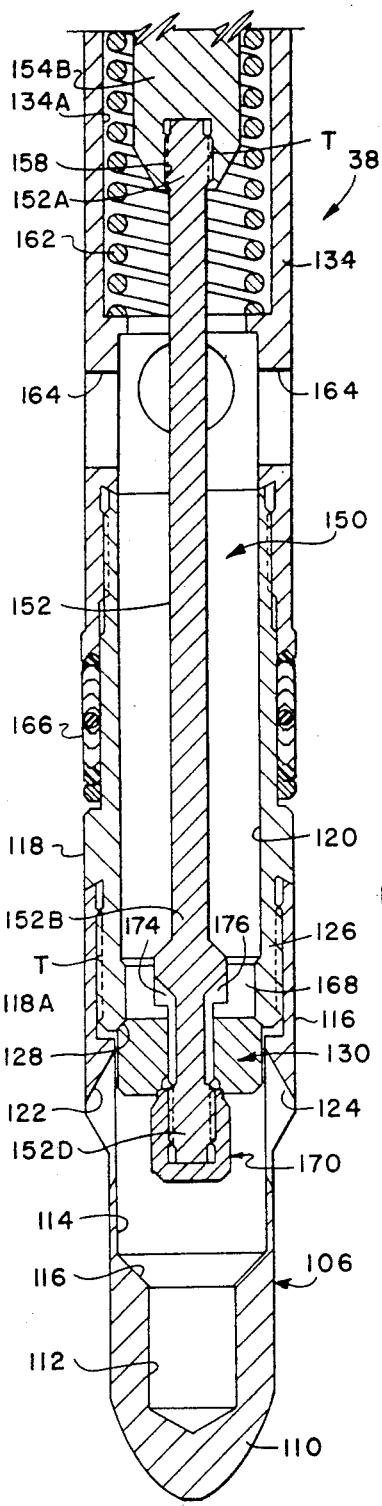
FIG. 6 is a longitudinal sectional view, partially broken away, of the gas lift safety valve of the present invention, shown in the valve closed position.
Figure 7:
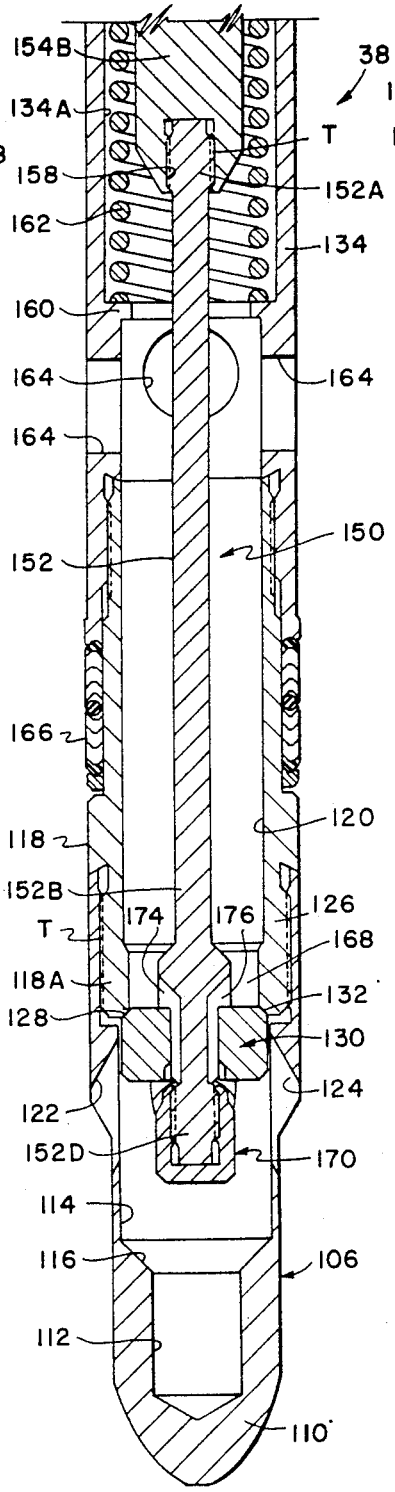
FIG. 7 is a view similar to FIG. 6, with the gas lift safety valve being in the valve equalizing position.
Figure 9:
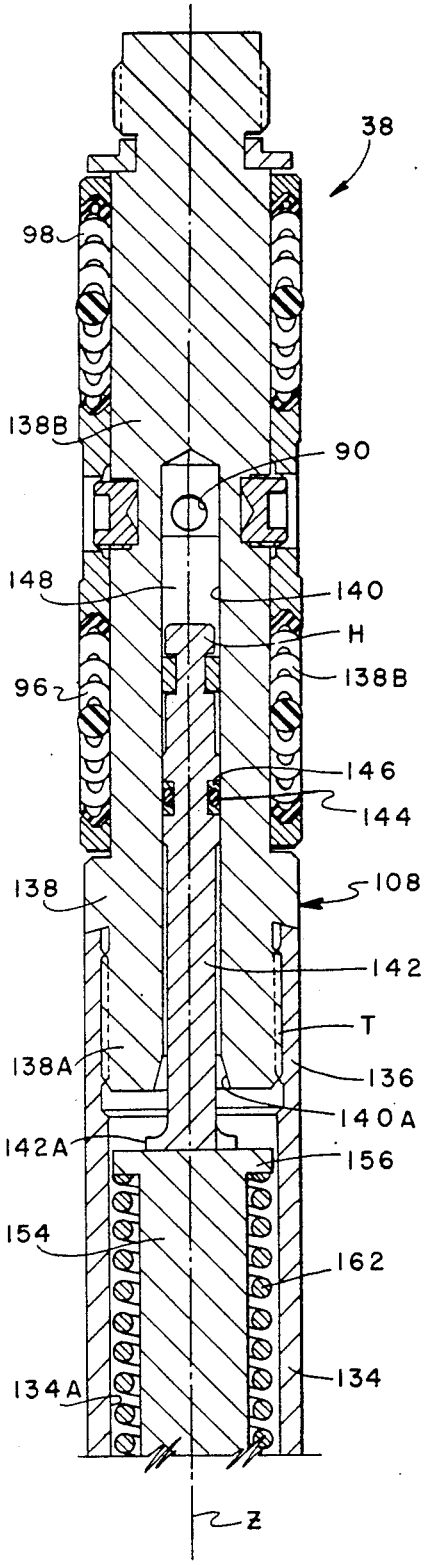
FIG. 9 is a longitudinal sectional view, partially broken away, of the upper half of the gas lift safety valve assembly shown in FIG. 2.

Referring now to FIG. 2, FIG. 6 and FIG. 9, the side pocket mandrel 42 has an elongated pocket 92 in which the safety valve 38 has been loaded, preferably by a kick-over tool as described in U.S. Pat. No. 4,294,313 to Harry E. Schwegman. The hydraulic flow control line 40 is connected in fluid communication with the inlet port 90 through a hydraulic fitting 94. The hydraulic control line 40 and the hydraulic fitting 94 deliver high pressure hydraulic control fluid into the pocket annulus 92A between the lift gas safety valve 38 and the pocket bore 92. The pocket annulus 92A is sealed above and below the inlet port 90 by annular packing seal members 96, 98.

The mandrel pocket 92 has an open upper end 100 (FIG. 2) through which the lift gas safety valve 38 is inserted by a kick-over tool. The side pocket mandrel 42 has a lower end outlet port 102 through which lift gas 46 conducted by the safety valve 38 is discharged. The lift gas flow conduit 58 is connected in fluid communication with the outlet port 102 by a hydraulic fitting 104. According to this arrangement, pressurized lift gas in the upper casing annulus 12A is selectively conducted to the lower annulus 12B through the flow conduit 58 into the bore of the packer P where it is discharged through outlet ports 74 into the lower casing annulus 12B.

Figure 10:
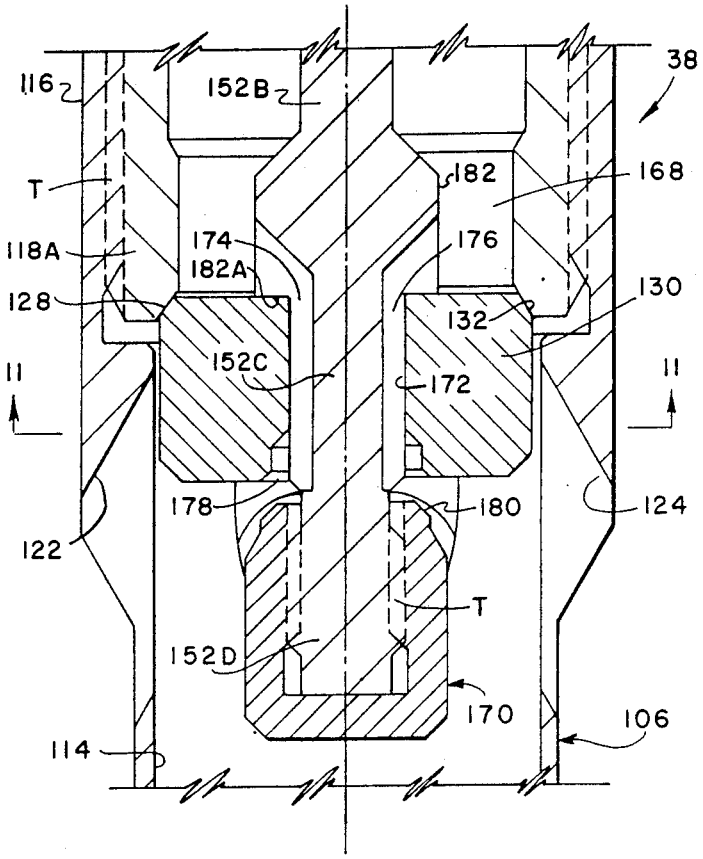
FIG. 10 is an enlarged longitudinal sectional view of the valve closure sealing components of the gas lift safety valve assembly; and, FIG. 11 is a sectional view of the lift gas safety valve taken along the line 11—11 of FIG. 10.

Referring now to FIG. 6, FIG. 9 and FIG. 10, the components of the lift gas safety valve assembly 38 will be described in greater detail. The lift gas valve assembly 38 includes an elongated valve body 106 onto which a hydraulic actuator 108 is mounted. The valve body 106 is an elongated, tubular member which is closed at one end by a radially tapered head 110. The valve body 106 and the radially tapered head 110 are intersected by a longitudinally extending, blind bore 112. The blind bore 112 is enlarged by a longitudinally extending counterbore 114. The main bore 112 transitions to the counterbore 114 across a beveled counterbore 116.

The valve body 106 further includes a radially upset, threaded box connection 116 on the opposite end which is joined in threaded connection with a packing mandrel 118. The packing mandrel 118 has an elongated, central bore 120 which is disposed in flow communication with the counterbore 114. The valve body 106 further includes lateral ports 122, 124 which are in communication with the main valve counterbore 114 for discharge of compressed lift gas conducted through the packing mandrel bore 120. The packing mandrel 118 has a threaded pin connector 126 which is joined in a threaded union T with the threaded box connector 116 of the main valve body 106. The lower end 118A of the packing mandrel has a beveled recess 128 in which an annular valve seat is formed. The annular seat 128 is disposed for sealing engagement with a primary valve closure member 130. The primary valve closure member 130 also is fitted with an annular seal member 132. The annular seal member 132 is adapted to produce a secure fluid seal by engagement against the valve seat 128 when the valve is closed, as shown in FIG. 6.

Referring now to FIG. 6 and FIG. 9, the actuator 108 is joined to the packing mandrel 118 by a return spring housing 134. The return spring housing 134 is joined at its upper end by a threaded box connector 136. The actuator assembly 108 includes an actuator mandrel 138 which is fitted with a threaded pin connector 138A at its lower end. The threaded pin connector 138A of the actuator mandrel 138 is joined in a threaded union T with the threaded box connector 136 of the return spring housing 134.

As can best be seen in FIG. 9, the actuator mandrel 138 has a longitudinally extending, central bore 140 which is in flow communication with the hydraulic inlet port 90 at its upper end, and which has a lower open end 140A through which an elongated piston 142 projects. The annulus 92A (FIG. 2) which immediately surrounds the hydraulic control fluid inlet port 90 is sealed below and above by annular packing members 96, 98. The annular packing members 96, 98 are mounted onto a reduced diameter section 138B of the actuator mandrel. The annulus between the piston 142 and the actuator mandrel bore 140 is sealed by an annular seal ring 144 which is mounted within an annular groove 146 formed in the piston 142. According to this arrangement, the piston 142 is movable in extension and retraction along the longitudinal axis Z of the safety valve assembly. As the piston 142 moves in extension and retraction, the piston head H and the seal ring 144 define the lower boundary of a variable volume pressure chamber 148 which is pressurized by hydraulic control fluid delivered through the inlet port 90 from the hydraulic control line 40. As the variable volume pressure chamber 148 is pressurized by hydraulic control fluid, the piston 142 is extended through the actuator bore 140 along the central axis Z.

The force developed by the actuator assembly 108 is applied by the piston 142 by engagement against a valve stem assembly 150. The valve stem assembly 150 includes an elongated valve stem 152 and a return spring mandrel 154. The return spring mandrel 154 has a radially projecting shoulder 156 formed at its upper end which is adapted for surface engagement against a radially projecting shoulder portion 142A of the piston 142. The lower end 154B of the return spring mandrel 154 has a threaded pocket 158 in which an upper end portion 152A of the valve stem 152 is joined in a threaded union T.

The return spring housing 134 has a radially inwardly projecting shoulder 160 which retains the lower end of a return spring 162 which is mounted about the return spring mandrel 154. The upper end of the return spring 162 is retained by the mandrel flange 156. According to this arrangement, the return spring 162 is compressed as the piston 142 is extended along the longitudinal axis Z. The return spring 162 is selected to apply an opposing force against the piston 142 which is sufficient to overcome the weight of the hydraulic control fluid in the control line 40 upon loss of hydraulic pressure.

Lift gas 46 pumped into the upper casing annulus 12A is delivered through the inlet port 44 into the annulus 92 between the offset mandrel housing 42 and the safety valve assembly 38. The lift gas 46 is conducted from the annulus 92 into the packing mandrel bore 120 through multiple inlet ports 164 which are formed in the sidewall of the return spring housing 134. The annulus 92 surrounding the inlet ports 164 is sealed at the upper end by the packing seal member 96 and the annulus 92 below the inlet ports 164 is sealed by an annular packing seal member 166. The cylindrical bore 134A of the return spring housing is sealed at its upper end by the threaded union T with the pin connector 138A of the actuator mandrel 138. Accordingly, lift gas 46 delivered through the inlet port 164 is constrained to flow through the cylindrical bore 120 of the packing mandrel 118 and through a discharge annulus 168 defined between the valve stem mandrel 152 and the packing mandrel bore 120.

Figure 11:
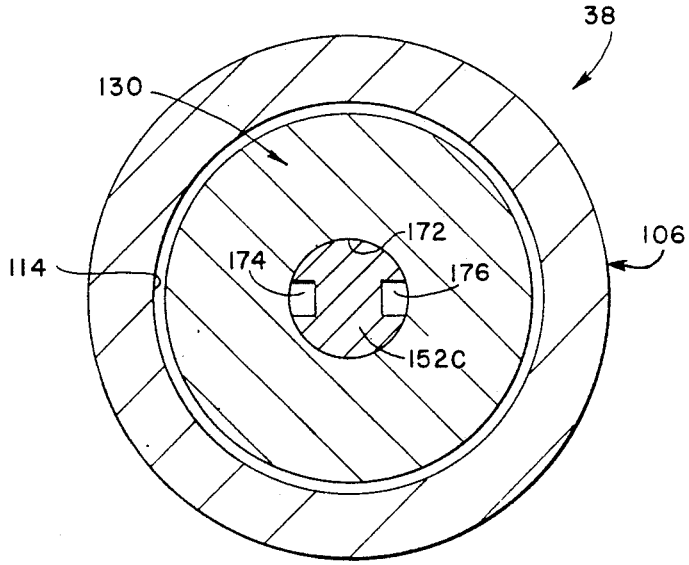

Referring now to FIG. 6, the discharge annulus 168 is selectively blocked and unblocked by the primary valve closure member 130 and by an auxiliary valve closure member 170. The primary valve closure member 130 is mounted for sliding movement along a lower end portion 152D of the valve stem. As can best be seen in FIG. 11, the primary valve closure member 130 has a central bore 172 through which the valve stem end portion 152C projects. The valve stem section 152C has first and second elongated slots 174, 176 which define bypass flow passages through the primary valve closure member 130. The bypass slots 174, 176 are selectively blocked and unblocked by the auxiliary valve closure member 170 which is secured onto the distal end portion 152D of the valve stem by a threaded union T. In this arrangement, the central bore 172 of the primary valve closure member 130 is enlarged by a beveled counterbore 178 which defines a valve seat for engaging the auxiliary valve closure member 170. The auxiliary valve closure member 170 has a beveled, annular face 180 which is adapted for seating engagement against the beveled, annular seat 178 as shown in FIG. 6.

Accordingly, the discharge annulus 168 is selectively blocked and unblocked by the compound assembly of the primary valve closure member 130 and the auxiliary valve closure member 170. Retraction of the main valve closure member 130 along the valve stem section 152C is limited by its engagement against the annular face 182A of a radially projecting shoulder member 182. The primary valve closure member 130 is extendable along the valve stem section 152C in the opposite direction until it engages the beveled seating face 180 of the auxiliary valve closure member 170 in response to retraction by the return spring 162. By this arrangement the discharge annulus 168 and the bypass slots 174, 176 are completely sealed upon the loss of hydraulic control pressure, as the result of the return force applied to the valve stem 152 by the return spring 162. The sealing surfaces 132 of the primary valve closure member 130 are driven into engagement against the annular valve seat 128, and the beveled face 180 of the auxiliary valve closure member 170 is driven into sealing engagement against the beveled annular seat 178 of the main valve closure member. Sealing engagement is maintained by the return spring and by the pressure exerted onto the closure members by the lift gas confined in the lower casing annulus.

According to an important feature of the present invention, when it is desired to equalize the pressure in the upper casing annulus 12A with respect to the lift gas pressure in the lower casing annulus 12B, hydraulic control fluid is pumped through the inlet port 90 into the actuator pressure chamber 148, thereby driving the piston 142 against the return spring mandrel 154 and also against the opposing force applied by the return spring 162. Sufficient hydraulic pressure must also be applied to overcome the pneumatic force developed across the face of the auxiliary valve closure member 170 by the lift gas which is present in the lower casing annulus 12B. When the opposing force of the return spring 162 and the pneumatic pressure force developed against the auxiliary valve closure member 170 have been overcome, the valve stem 152 is extended through the packing mandrel 118, with the result that the auxiliary valve closure member 170 is displaced out of sealing engagement with the beveled seat 178 of the primary valve closure member 130.

As the auxiliary valve closure member 170 is extended relative to the primary valve closure member 130, the bypass channels 174, 176 are unblocked, thereby permitting the flow of lift gas from the lower casing annulus upwardly through the packing mandrel bore 120 and in reverse flow through the flow ports 164 and through the flow port 44 into the upper casing annulus 12A, thereby equalizing the pressure in the upper casing annulus 12A with respect to the lift gas pressure in the lower casing annulus 12B. During the period that equalizing flow is occurring, the primary valve closure member 130 remains sealed against the valve seat 128, with reverse flow being conducted only through the bypass channels 174, 176. After equalization has been accomplished, however, the pressure differential across the primary valve closure member 130 vanishes. Accordingly, the only force remaining to be overcome after equalization is the sum of the opposing force of the return spring 162 and the equalization gas pressure in the casing annulus.

The effective equalizing seat area of the auxiliary valve closure member 170 should always be greater than the effective piston area so that the safety valve 38 will operate in a fail-safe mode in the event of loss of hydraulic control pressure. Preferably, the ratio of the effective piston area relative to the equalizing seat area is about 1:1.1. According to this arrangement, a pressure of 1.1 times the shut in pressure plus the return force of the spring is required to remove the auxiliary valve closure member 170 from its seat to permit equalization to occur. Assuming a one square inch effective piston face area and that the return spring 162 develops a return force of 1,000 pounds, and assuming 1,000 psi of lift gas is shut in within the lower casing annulus 12B, then the hydraulic pressure applied to the piston must exceed about 2,200 psi to displace the auxiliary valve closure member 170.

Figure 8:
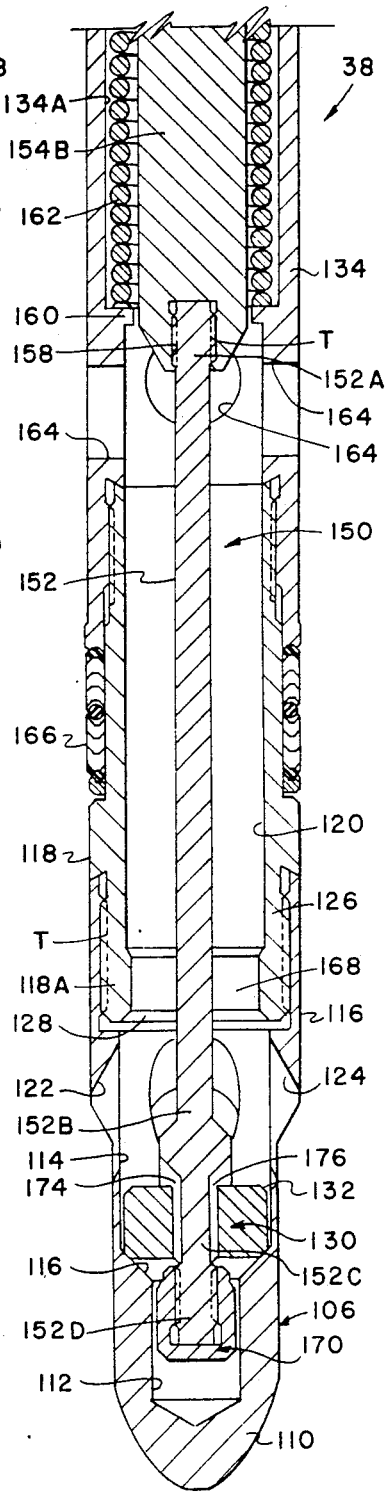
FIG. 8 is a view similar to FIG. 6 with the gas lift safety valve being shown in the valve open position.

After equalization has occurred, and assuming 1,000 psi in the upper and lower casing annulus, only about 2,000 psi of hydraulic control line pressure is required to maintain the safety valve in the valve open position as shown in FIG. 8. In the valve open position, the discharge flow ports 122, 124 are completely unblocked, and the auxiliary valve closure member 170 is received within the bore 112 of the radially tapered head 110.

Accordingly, it will be appreciated that the maintenance hydraulic pressure level required to maintain the safety valve in the valve open position is substantially reduced with respect to the pressure levels required to operate conventional lift gas safety valves. According to the foregoing lift gas safety valve arrangement of the present invention, the maintenance pressure level is only slightly greater than the opposing force developed by the return spring, since the two component valve closure assembly makes equalization possible, thereby dissipating the opposing force which would otherwise be produced by the lift gas in the lower casing annulus.

According to the foregoing arrangement, the bore 36 of side pocket mandrel 34 has the same effective flow diameter as the bore 25 of production tubing 24. A large annular flow passage area 62 is defined between the stinger conduit 60 and the packer bore 20 which will accommodate large volume gas lift operations without imposing a production flow limitation through the packer. Because the flow passage bore of the side pocket mandrel is not restricted, service tools of a standard size can be extended throughout the length of the well for performing service operations in which the production tubing and completion bore are traversed by a tool for cleaning, bailing, swabbing, running corrosion or pressure surveys, and the like.

It will be appreciated that the well completion assembly, including the lift gas safety valve, production safety valve and production seal unit can be made up and tested as a unit, and then run in and installed as a unitary assembly. Moreover, the completion assembly is tubing retrievable above the packer, with retrieval of the completion assembly being carried out without disturbing the packer or any of the equipment hung off of the packer. Both the main production flow and the annulus lift gas flow can be shut off automatically. When it is necessary to wire line service the lift gas safety valve, the high pressure ga in the lower casing annulus is vented into the bore of the production tubing string through the lower casing annulus relief valve. When it is necesary to wireline service some other component above the packer, the upper casing annulus is equalized with the lower casing annulus by operating the lift gas safety valve in the equalizing mode.

The completion assembly, including the production tubing, production safety valve and gas lift safety valve can be installed by a straight stabbing maneuver which does not involve rotary manipulation of flow conductors in place in the well. The production stinger conduit extended through the bore of a large diameter packer defines separate concentric flow passages for lift gas and production fluids substantially without limiting or restricting production flow, while simultaneously providing a large flow path for the lift gas through the annular passage between the stinger conduit and the packer bore.

Although the invention has been described with reference to a specific embodiment, and with reference to a specific gas lift application, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications or embodiments as fall within the true scope of the invention:

What is claimed is:

1. A lift gas safety valve assembly comprising, in combination:

a valve body having a longitudinal bore defining a lift gas flow passage, said valve body being intersected by a first opening therethrough defining a lift gas inlet port and being intersected by a second opening therethrough defining a lift gas discharge port, and having a valve seat formed on said valve body in flow registration with, the lift gas flow passage;

a surface controllable power actuator assembly attached to said valve body, said power actuator assembly including a valve stem disposed within said lift gas flow passage for extension and retraction relative to said valve seat in response to the application and removal of a control signal to said actuator assembly, and a discharge annulus being formed in said valve body intermediate said valve stem and said valve body; and, a compound valve closure assembly mounted onto said valve body for selectively interrupting and establishing fluid communication between said lift gas flow passage and said lift gas discharge port, said compound valve closure assembly including a primary valve closure member, an auxiliary valve closure member and a bypass flow conductor defining a bypass flow passage through said primary valve closure member, said primary valve closure member being mounted onto said valve stem for movement from a seated position on said valve seat to an unseated position in response to retraction and extension of said valve stem, respectively, and said auxiliary valve closure member being mounted on said valve stem for movement from a seated position on said primary valve closure member in which said bypass flow passage is closed, to an unseated position in which said bypass flow passage is opened in response to retraction and extension of said valve stem, respectively.

2. A lift gas safety valve assembly as defined in claim 1, said valve body having a closed head and a longitudinally extending, blind bore formed therein, the lift gas discharge port being a lateral opening formed in said valve body intermediate said head and said discharge annulus, the auxiliary valve closure member being extendable into said blind bore in response to extension of said stem.

3. A lift gas safety valve assembly as defined in claim 1, said auxiliary valve closure member being secured to the distal end of said valve stem, and said valve stem having a radially projecting shoulder located at a longitudinally spaced location with respect to said auxiliary valve closure member, said primary valve closure member being movably mounted onto said valve stem for sliding movement between said radial shoulder and said auxiliary valve closure member.

4. A lift gas safety valve assembly as defined in claim 1, wherein said primary valve closure member has a longitudinally extending central bore, and said valve stem is projecting through said central bore, said valve stem having a longitudinally extending slot defining said bypass flow conductor passage intermediate the interface between said primary valve closure member and said valve stem.

5. A lift gas safety valve assembly as defined in claim 1, said power actuator assembly comprising:

an actuator mandrel having a pressure chamber and an inlet port communicating with said pressure chamber for permitting the flow of control fluid into and out of said pressure chamber;

a piston disposed in said pressure chamber for extension and retraction in response to the application and removal of pressurized control fluid to and from said pressure chamber, respectively;

a return spring assembly connected between said actuator mandrel and said valve body, said return spring assembly including a return spring housing, a return spring guide mounted for longitudinal extension and retraction within said spring housing, and a return spring disposed within said return spring housing for yieldably opposing extension movement of said return spring guide; and, said piston being coupled in driving engagement against said return spring guide, and said return spring guide being coupled to said valve stem.

6. A lift gas safety valve assembly comprising, in combination:

a valve body having a longitudinal bore defining a lift gas flow passage, said valve body being intersected by a first opening therethrough defining a lift gas inlet port and being intersected by a second opening therethrough defining a lift gas discharge port, and having a valve seat formed on said valve body in flow registration with the lift gas flow passage;

a power actuator assembly attached to said valve body, said power actuator assembly including a valve stem disposed within said lift gas flow passage for extension and retraction relative to said valve seat in response to the application and removal of a control signal to said actuator assembly, and a discharge annulus being formed in said valve body intermediate said valve stem and said valve body;

a compound valve closure assembly mounted onto said valve body for selectively interrupting and establishing fluid communication between said lift gas flow passage and said lift gas discharge port, said compound valve closure assembly including a primary valve closure member, an auxiliary valve closure member and a bypass flow conductor defining a bypass flow passage through said primary valve closure member, said primary valve closure member being mounted onto said valve stem for movement from a seated position on said valve seat to an unseated position in response to retraction and extension of said valve stem, respectively, and said auxiliary valve closure member being mounted on said valve stem for movement from a seated position on said primary valve closure member in which said bypass flow passage is closed, to an unseated position in which said bypass flow passage is opened in response to retraction and extension of said valve stem, respectively;

said power actuator assembly including an actuator mandrel having a pressure chamber and an inlet port communicating with said pressure chamber for permitting the flow of control fluid into and out of said pressure chamber; and, first and second annular seal means externally surrounding said actuator mandrel, said control pressure inlet port being disposed between said first and second annular seal means.

7. A lift gas safety valve assembly as defined in claim 6, including a tubular packing mandrel connected to said valve body, said tubular packing mandrel having a bore disposed in flow communication with said lift gas flow passage;

a tubular return spring housing connected to said packing mandrel, said return spring housing having a radial bore defining said lift gas inlet port in communication with said lift gas flow passage; and, a third annular seal means externally surrounding said packing mandrel at a location intermediate said lift gas inlet port and said valve body.

8. Lift gas safety valve apparatus comprising, in combination:

a tubular mandrel having a longitudinal bore defining a production flow passage therethrough and including pocket wall means defining a longitudinally extending pocket laterally offset with respect to said main bore, said pocket wall means having an open upper end, a lift gas discharge port formed on its lower end, and said pocket wall means being radially intersected by a lift gas inlet port at a location intermediate said open end and said discharge port;

a lift gas safety valve assembly disposed within said pocket, said lift gas safety valve including a valve body having an internal port disposed in flow communication with said lift gas inlet port of said pocket wall means, an outlet port disposed for flow communication with the discharge port of said pocket wall means, and having a longitudinal bore defining a lift gas flow passage in communication with said lift gas inlet port and said lift gas outlet port;

a power actuator assembly attached to said valve body, said power actuator assembly including a valve stem disposed within said lift gas flow passage for extension and retraction relative to said valve seat in response to the application and removal of a control signal to said actuator assembly, and a discharge annulus being formed in said valve body intermediate said valve stem and said valve body; and, a compound valve closure assembly mounted onto said valve body for selectively interrupting and establishing fluid communication between said lift gas flow passage and said lift gas discharge port, said compound valve closure assembly including a primary valve closure member and an auxiliary valve closure member, said primary valve closure member having a longitudinal bore through which said valve stem is extended;

means defining a longitudinal bypass flow passage intermediate said primary valve closure member and said valve stem; and, said primary valve closure member being slidably mounted onto said valve stem for movement from a seated position on said valve seat to an unseated position in response to retraction and extension of said valve stem, respectively, and said auxiliary valve closure member being mounted on said valve stem for movement from a seated position on said primary valve closure member in which said bypass flow passage is closed, to an unseated position in which said bypass flow passage is opened in response to retraction and extension of said valve stem, respectively.

9. A lift gas safety valve assembly as defined in claim 8, including first annular seal means externally surrounding said valve body between said upper open end and said lift gas inlet port and second annular seal means surrounding said valve body between said lift gas inlet port and said lift gas discharge port.

10. In a lift gas safety valve assembly of the type including a valve body having an inlet port, and an outlet port and a longitudinal bore defining a fluid flow passage in communication with said inlet port and said outlet port and having a valve seat formed on said valve body in registration with said flow passage intermediate said inlet port and said outlet port, a power actuator attached to said valve body, said power actuator including a valve stem disposed within said fluid flow passage for extension and retraction relative to said valve seat in response to a control signal, and a discharge annulus being defined intermediate the valve stem and said valve body in registration with said fluid flow passage, the improvement comprising:

a primary valve closure member having a longitudinal bore through which said valve stem is extended, said primary valve closure member being slidably mounted on said valve stem for movement from a seated position on said valve seat to an unseated position in response to retraction and extension of said valve stem;

a bypass flow passage being defined through said primary valve closure member for establishing fluid communication between said discharge annulus and said outlet port when the primary valve closure member is in the seated position; and, an auxiliary valve closure member mounted onto said valve stem, said auxiliary valve closure member being movable from a seated position on said primary valve closure member in which said bypass flow passage is closed to an unseated position in which said bypass flow passage is opened in response to retraction and extension of the valve stem, respectively.

11. A lift gas safety valve assembly comprising, in combination:

a valve body having a longitudinal bore defining a fluid flow passage, an inlet port communicating with said fluid flow passage, an outlet port communicating with said fluid flow passage and having a valve seat formed in said valve body intermediate said flow passage and said outlet port;

a power actuator attached to said valve body, said power actuator including a valve stem disposed within said fluid flow passage for extension and retraction relative to said valve seat in response to a control signal, a discharge annulus being defined intermediate said valve stem and said valve body in registration with said valve seat;

a first valve closure member having a longitudinal bore through which said valve stem is extended, said first valve closure member being slidably mounted onto said valve stem, said first valve closure member being movable from a seated position on said valve seat to an unseated position in response to retraction and extension of said valve stem, respectively, for interrupting and establishing fluid communication through said discharge annulus;

bypass flow means defining a bypass flow passage through said first valve closure member for establishing fluid flow communication between said discharge annulus and said outlet port when said first valve closure member is in said seated position; and, a second valve closure member mounted onto said valve stem, said second valve closure member being movable from a seated position on said first valve closure member to an unseated position for closing and opening said bypass discharge annulus in response to retraction and extension of said valve stem relative to said first valve closure member, respectively.

12. A lift gas safety valve assembly comprising, in combination:

a valve body having a longitudinal bore defining a fluid flow passage, an inlet port communicating with said fluid flow passage, an outlet port communicating with said fluid flow passage and a valve seat formed on said valve body intermediate said flow passage and said outlet port;

an actuator assembly attached to said valve body, said actuator assembly including a power housing having a pressure chamber and an inlet port communicating with said pressure chamber for permitting the flow of control fluid into and out of said pressure chamber;

a piston disposed in said pressure chamber for extension and retraction in response to the application and removal of pressurized control fluid to and from said pressure chamber, respectively;

a valve stem having a first end portion coupled to said piston and having a second end portion disposed in said valve body flow passage for extension and retraction relative to said valve seat;

a first valve closure member having a longitudinal bore through which said valve stem is extended, said first valve closure member being slidably mounted onto said valve stem, said first valve closure member being movable from a seated position on said valve seat to an unseated position in response to retraction and extension of said valve stem for interrupting and establishing fluid communication between said valve body flow passage and said outlet port; respectively;

bypass flow means defining a bypass flow passage through said first valve closure member for establishing fluid flow communication between said valve body flow passage and said outlet port when said first valve closure member is in said seated position; and, a second valve closure member mounted onto said valve stem, said second valve closure member being movable from a seated position on said first valve closure member to an unseated position for closing and opening said bypass flow passage in response to retraction and extension of said valve stem relative to said first valve closure member, respectively.

* * * * *